US012690741B2

(12) United States Patent
Rukavina et al.

(10) Patent No.: US 12,690,741 B2
(45) Date of Patent: Jul. 28, 2026

(54) FLOOR CLEANER

(71) Applicant: Techtronic Cordless GP, Anderson, SC (US)

(72) Inventors: Douglas M. Rukavina, Concord, NC (US); John Morphey, Concord, NC (US); Anthony Ferrigno, Mooresville, NC (US); Daniel Smith, Charlotte, NC (US)

(73) Assignee: TECHTRONIC FLOOR CARE TECHNOLOGY LIMITED, Tortola (VG)

( * ) Notice: Subject to any disclaimer, the term of this patent is extended or adjusted under 35 U.S.C. 154(b) by 408 days.

(21) Appl. No.: 18/248,207

(22) PCT Filed: Oct. 8, 2021

(86) PCT No.: PCT/US2021/054115
§ 371 (c)(1),
(2) Date: Apr. 6, 2023

(87) PCT Pub. No.: WO2022/076783
PCT Pub. Date: Apr. 14, 2022

(65) Prior Publication Data

US 2024/0000282 A1 Jan. 4, 2024

Related U.S. Application Data

(60) Provisional application No. 63/089,156, filed on Oct. 8, 2020.

(51) Int. Cl.

| | |
|---|---|
| ***A47L 11/40*** | (2006.01) |
| ***A47L 11/30*** | (2006.01) |
| ***A47L 11/34*** | (2006.01) |

(52) U.S. Cl.
CPC ..... *A47L 11/4083* (2013.01); *A47L 11/30* (2013.01); *A47L 11/34* (2013.01); *A47L 11/4016* (2013.01); *A47L 11/4088* (2013.01)

(58) Field of Classification Search
CPC ..... A47L 11/40; A47L 11/4083; A47L 11/34; B08B 5/04
See application file for complete search history.

(56) References Cited

U.S. PATENT DOCUMENTS

| | | | |
|---|---|---|---|
| 8,448,293 | B2 | 5/2013 | Sepke |
| 10,602,903 | B2 | 3/2020 | Johnson et al. |

(Continued)

FOREIGN PATENT DOCUMENTS

| | | | | |
|---|---|---|---|---|
| CA | 3012999 | A1 * | 10/2018 | ..... A47L 11/085 |
| DE | 202017107509 | U1 | 3/2018 | |
| GB | 2423240 | A | 8/2006 | |

OTHER PUBLICATIONS

International Search Report and Written Opinion for Application No. PCT/US2021/054115 dated Feb. 28, 2022 (12 pages).

*Primary Examiner* — Michael D Jennings
(74) *Attorney, Agent, or Firm* — Michael Best & Friedrich LLP

(57) ABSTRACT

A floor cleaner has a fluid flow path, a fluid flow motor, a liquid distribution assembly, and a recovery tank positioned in the fluid flow path and configured to receive liquid-laden air from the air inlet. The liquid distribution assembly has a first supply tank for a first liquid, a second supply tank for a second liquid, and a mixing module for mixing the first liquid and the second liquid. The mixing module has a mixing chamber that allows the first and second liquids to mix before being expelled through an outlet of the mixing module. The mixing module includes a closure that is movable between a closed position and an open position. In the closed position, the closure closes the outlet to prevent (Continued)

fluid flow through the outlet. In the open position, the closure opens the outlet to allow fluid flow through the outlet.

25 Claims, 4 Drawing Sheets

(56) References Cited

U.S. PATENT DOCUMENTS

| | | | | |
|---|---|---|---|---|
| 2011/0079248 | A1* | 4/2011 | Huffman | A47L 11/4011 134/21 |
| 2013/0174874 | A1* | 7/2013 | Huffman | A47L 11/4088 134/21 |
| 2019/0117033 | A1* | 4/2019 | Miller | A47L 11/34 |
| 2021/0330159 | A1* | 10/2021 | Rukavina | A47L 11/4016 |

* cited by examiner

FLOOR CLEANER

CROSS-REFERENCE TO RELATED APPLICATIONS

This application claims priority to U.S. Provisional Patent Application No. 63/089,156, filed Oct. 8, 2020, the entire contents of which are hereby incorporated by reference herein.

BACKGROUND

The present disclosure relates to floor cleaners, and more particularly, a wet floor cleaner, and liquid distribution and liquid mixing configurations thereof.

A wet floor cleaner typically includes one or more liquids to distribute to a surface to be cleaned and a method of distributing and mixing the one or more liquids.

SUMMARY

In one embodiment a floor cleaner is disclosed including a fluid flow path extending from an air inlet to an air outlet, a fluid flow motor configured to generate air flow along the fluid flow path, and a liquid distribution assembly. The liquid distribution assembly is configured to distribute liquid to a surface to be cleaned. The liquid distribution assembly includes a first supply tank for a first liquid, a second supply tank for a second liquid, and a mixing module for mixing the first liquid and the second liquid. The mixing module includes a first inlet in communication with the first supply tank, a second inlet in communication with the second supply tank, a mixing chamber connected to the first and second inlets, an outlet, and a spring-loaded closure movable between a closed position and an open position. In the closed position the spring-loaded closure closes the outlet and in the open position the spring-loaded closure opens the outlet. The spring-loaded closure is operatively connected to an actuator connected to a user interface. The floor cleaner further includes a recovery tank positioned in the fluid flow path and configured to receive liquid-laden air from the air inlet. The recovery tank includes a recovery tank inlet in fluid communication with the air inlet and a recovery tank outlet in fluid communication with the air outlet.

In another embodiment, a floor cleaner having a mixing chamber is disclosed, having a liquid distribution assembly configured to distribute liquid to a surface to be cleaned. The liquid distribution assembly includes a mixing module having a first inlet for receiving a first liquid, a second inlet for receiving a second liquid, an outlet for distributing the first liquid and the second liquid to the surface to be cleaned, a mixing chamber connected to the first and second inlets, and a spring-loaded closure operatively connected to an actuator connected to a user interface.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Embodiments of the invention relate to a floor cleaner, specifically a liquid distribution arrangement and a liquid mixing arrangement of a wet floor cleaner. In the area of wet floor cleaners, such as carpet extractors or hard floor cleaners, a combination of liquids, such as water and cleaning detergent, may allow a user to optimize cleaning based on the surface type and soil level. In a wet floor cleaner, such as a carpet extractor or a hard floor cleaner, water and/or cleaning solution is dispensed to a surface to be cleaned and extracted along with the dirt and debris on the surface.

In wet floor cleaners with multiple cleaning liquids, an onboard mixing module may be used for combining the liquids. Additionally, the liquid distribution arrangement utilizes a valve or closure mechanism to stop the flow of liquid while the floor cleaner is not in use. Embodiments of the current invention show the valve or closure mechanism included in the mixing module. In its various embodiments, the inventive liquid mixing arrangement allows for simple, compact, and consistent mixing of cleaning liquids, with minimal user input required.

Figure 1:
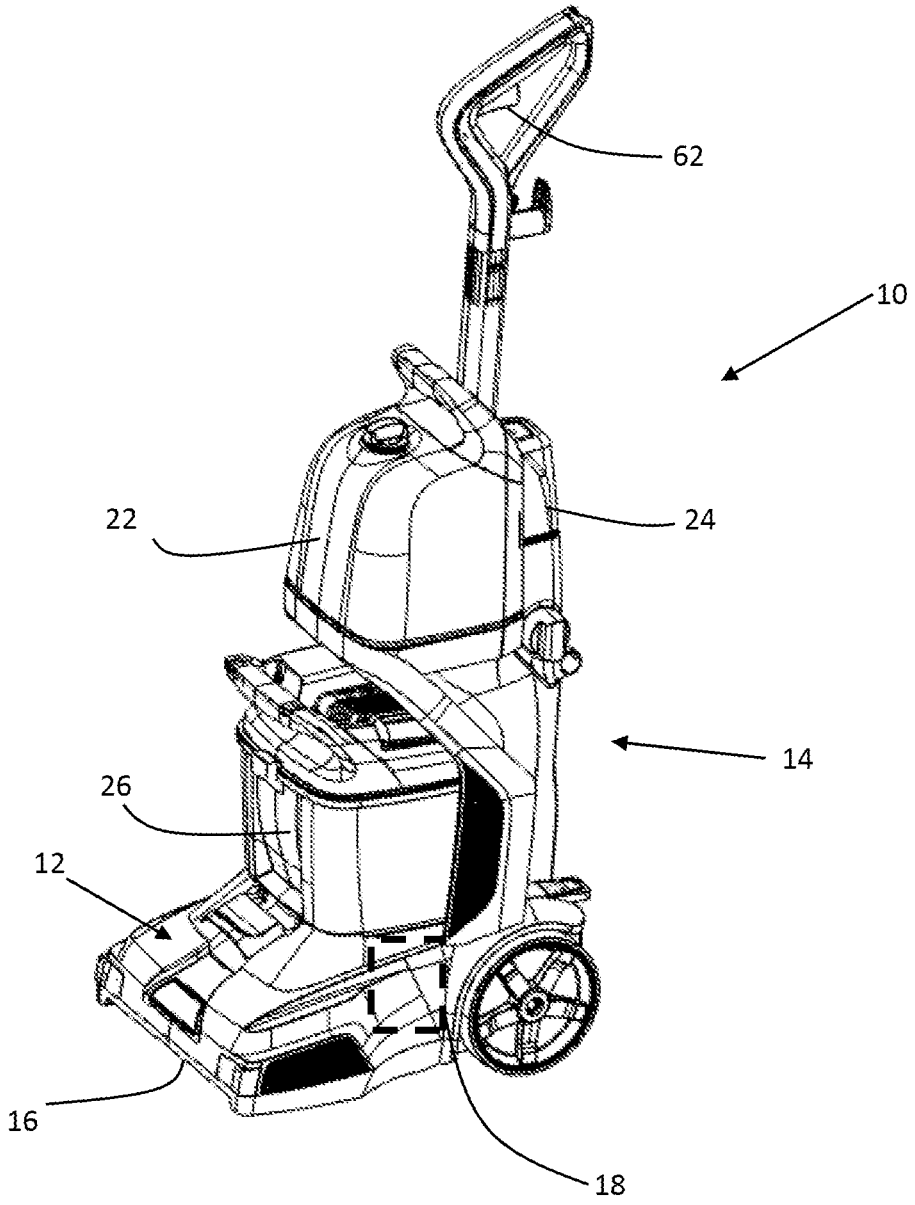
FIG. 1 is a perspective view of a floor cleaner according to one embodiment of the invention.
Figure 2:
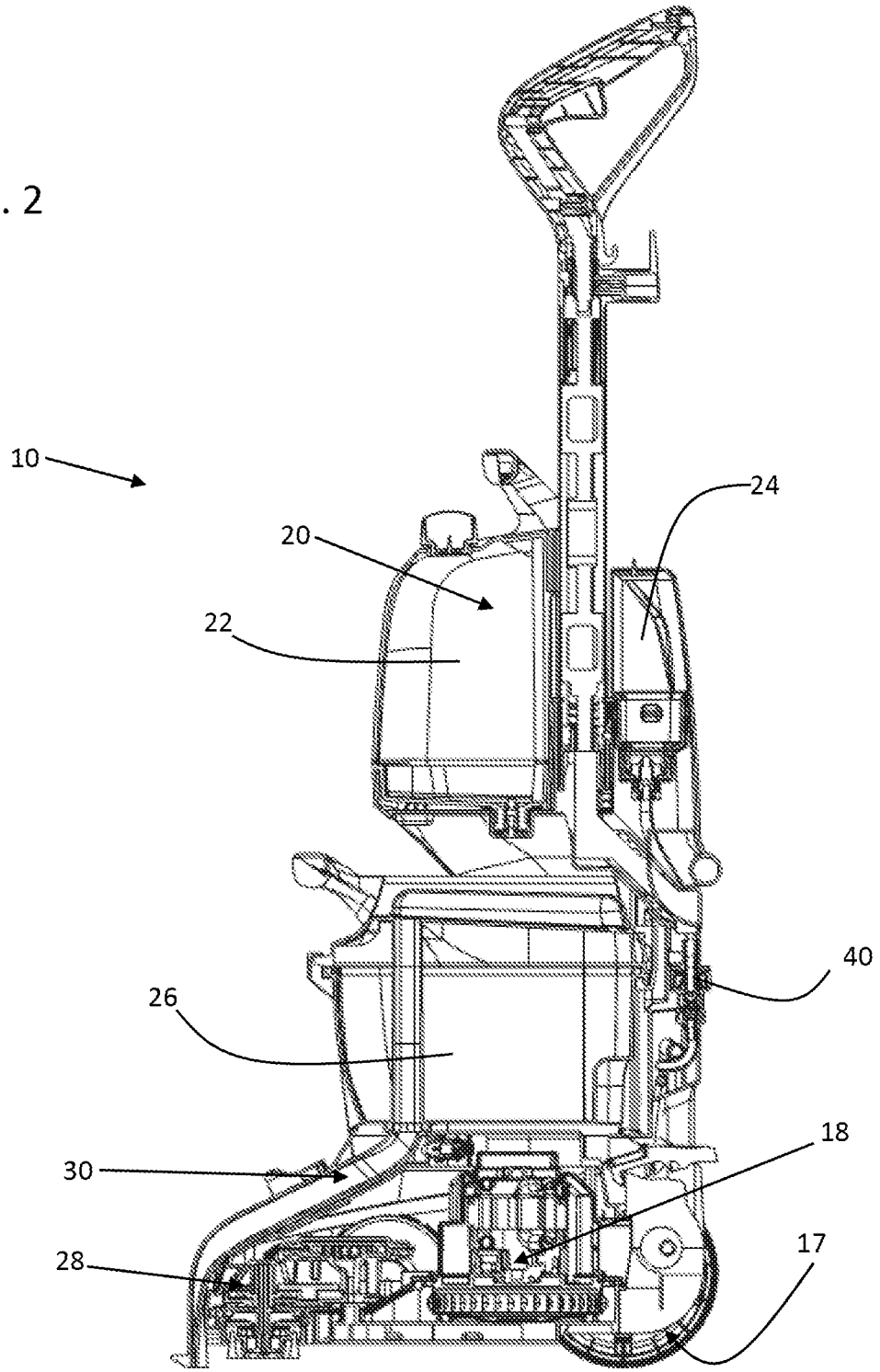
FIG. 2 is a cross-sectional view of the floor cleaner shown in FIG. 1.
Figure 3:
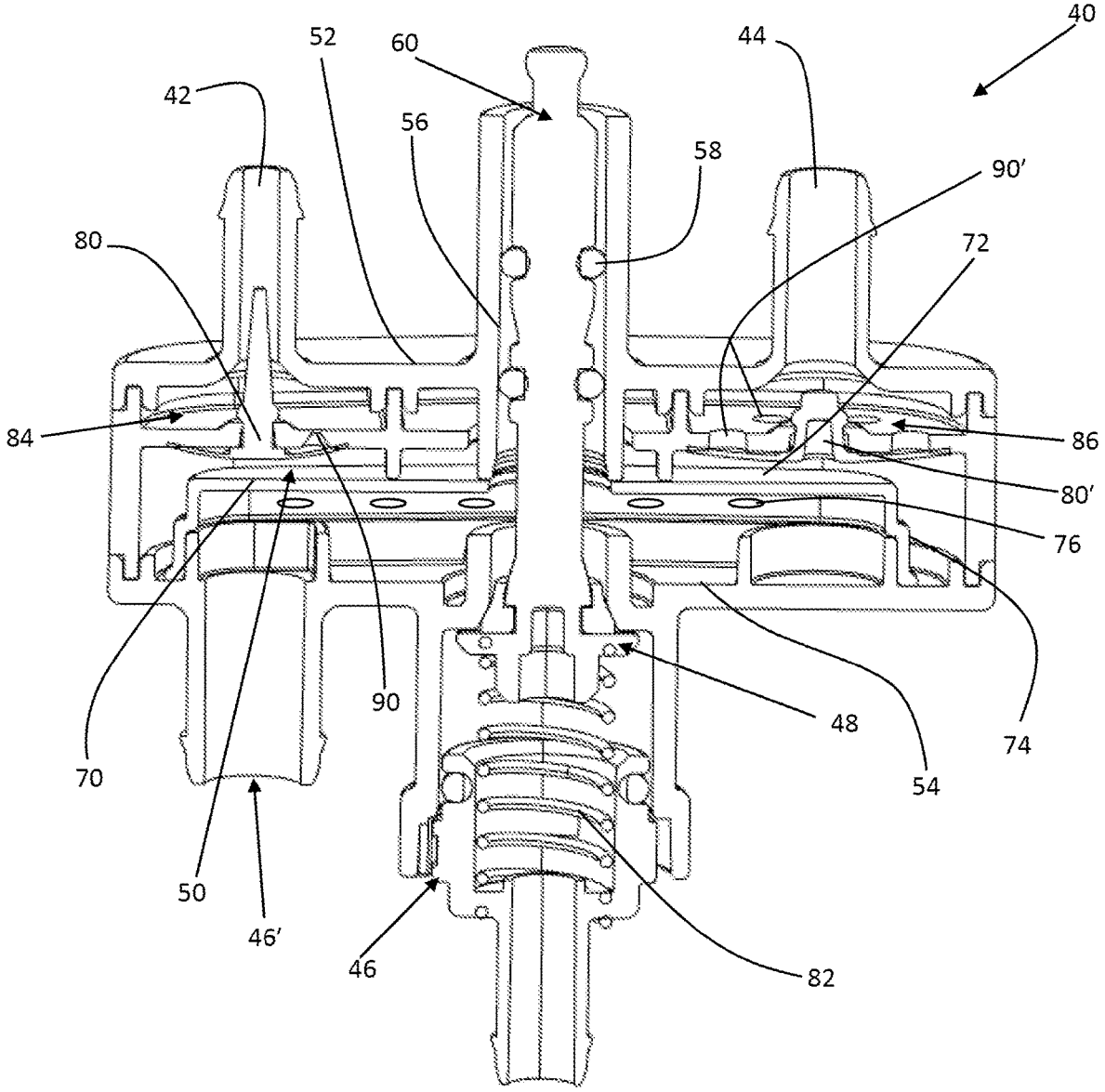
FIG. 3 is a cross-sectional view of a mixing module of the floor cleaner shown in FIG. 2.

FIGS. 1-3 illustrate a floor cleaner 10 according to an embodiment of the invention. The floor cleaner 10 is a wet floor cleaner such as an extractor, a hard floor cleaner, or a steam mop. The floor cleaner 10 has a fluid flow path 30 extending from an air inlet 16 to an air outlet 17. The air inlet 16 is positioned on a foot portion 12 that is movable along a surface to be cleaned. The foot portion 12 is pivotably connected to a body portion 14. The floor cleaner 10 further includes a fluid flow motor 18 positioned in the fluid flow path 30 and a liquid distribution assembly 20 configured to distribute liquid to the surface to be cleaned. The fluid flow motor 18 is configured to generate air flow along the fluid flow path 30 to draw liquid and debris from the surface to be cleaned through the air inlet 16. The liquid distribution assembly 20 includes a first supply tank 22 for a first liquid, a second supply tank 24 for a second liquid, and a mixing module or mixing valve 40 for mixing the first liquid and the second liquid. The liquid distribution assembly 20 further includes a distributor 28 in the foot portion 12 in fluid communication with the mixing module 40 to distribute liquid to the surface to be cleaned. In other embodiments, the liquid distribution assembly 20 includes three or more supply tanks. The additional supply tanks allow for additional cleaning liquids, for example detergents, sanitizers, and fragrances.

The floor cleaner 10 includes a recovery tank 26 positioned in the fluid flow path 30 and configured to receive liquid-laden air from the air inlet 16. The recovery tank 26 is in fluid communication with the air inlet 16 and the air outlet 17. The recovery tank 26 includes an air/liquid separator (not shown) to separate liquid and debris from the air flow.

When using a wet floor cleaner, such as an extractor or a hard floor cleaner, it can be advantageous to have one or more different liquids to distribute to the surface to be cleaned, such as water, diluted detergent, concentrated detergent, sanitizer, or the like. Based on factors such as surface type and soil level, it may be advantageous to combine two or more liquids in desired concentrations. In the illustrated embodiment, the mixing module 40 allows a combination of the first liquid and the second liquid to be distributed to the surface to be cleaned. The mixing module 40 includes a first inlet 42 in communication with the first supply tank 22, connected, for example, by a tube between the first inlet 42 and first supply tank 22, and a second inlet 44 in communication with the second supply tank 24, connected, for example, by a tube between the second inlet 44 and second supply tank 24. In other embodiments, the mixing module 40 includes three or more inlets. In the illustrated embodiment, the first liquid and the second liquid combine in a mixing chamber 50 that is connected to the first and second inlets 42, 44. The combined first and second fluid exit the mixing module through a first outlet 46 or a second outlet 46', the second outlet 46' discussed further below. In one embodiment, the first outlet 46 is connected to the distributor in the foot portion 12 configured to distribute liquid from the mixing module 40 to the surface to be cleaned. The first outlet 46 is covered by a closure 48. In the illustrated embodiment, the closure 48 is spring-loaded. The closure 48 is movable between a closed position and an open position. In the closed position, the closure 48 closes the first outlet 46, preventing fluid flow through the first outlet 46. In the open position, the closure 48 opens the first outlet 46, allowing fluid flow through the first outlet 46.

The closure 48 is operatively connected to an actuator 60 to move the closure 48 between the closed and open positions. The actuator 60 is connected to a user interface 62 to allow user actuation of the closure 48. In the embodiment illustrated in FIGS. 1 and 3, the user interface 62 is a trigger and the actuator 60 is a rod. User actuation of the trigger 62 presses the rod 60, which moves the closure 48. In the embodiment illustrated in FIG. 3, the rod 60 passes through the mixing chamber 50. In one embodiment, the closure is integral with the rod. In another embodiment, the closure is spaced apart or offset from and operatively connected to the rod. In one embodiment, the closure includes a spring 82 pressing the closure toward the closed position to inhibit liquid from dispensing unless the closure is opened by the user. In one embodiment, the actuator is a solenoid actuator.

In the illustrated embodiment, the mixing module 40 includes an upper side 52 and a lower side 54 opposite the upper side 52. The first inlet 42 and the second inlet 44 are positioned in the upper side of the mixing module 40. The first outlet 46 is positioned in the lower side 54. The mixing chamber 50 is positioned between the inlets 42, 44 of the upper side 52 and the first outlet 46 of the lower side 54. This allows adequate time, space, and surface area for the first liquid and the second liquid to mix in the mixing chamber 50 before exiting the first outlet 46. The upper side 52 includes a cylindrical bore 56 aligned with the outlet 46. The rod 60 passes through the cylindrical bore 56 sealingly engaging the bore. In the embodiment illustrated in FIG. 3, one or more o-rings 58 surround the rod 60 to sealingly engage the cylindrical bore 56. The rod 60 is movable along the cylindrical bore 56 to move the spring-loaded closure 48 between the closed and open positions.

In the embodiment illustrated in FIG. 3, the mixing module 40 further includes a barrier 70 positioned between the first and second outlets 46, 46' and at least one of the first inlet 42 and the second inlet 44. The barrier 70 inhibits liquid flowing directly from the first inlet 42 or the second inlet 44 through the outlets 46, 46' prior to mixing. The barrier 70 promotes the mixing of the first liquid and the second liquid in the mixing chamber 50. In the illustrated embodiment, the barrier 70 includes a top portion 72 spaced from the lower side 54 offset from the outlets 46, 46', a sidewall 74 extending from the top portion 72 toward the lower side 54, and one or more openings 76 forming a liquid passageway between the mixing chamber 50 and the outlets 46, 46'. In this embodiment, the barrier 70 is generally dome-shaped with a flat top portion 72 extending beneath the first inlet 42 and second inlet 44. The barrier 70 fluidly isolates the outlets 46, 46' from the first inlet 42 and the second inlet 44 except by the one or more openings 76. As illustrated, the openings 76 extend through the barrier sidewall 74. In one embodiment, the sidewall 74 may be spaced from the lower side 54 leaving a predetermined gap between the sidewall 74 and the lower side 54, the gap forming the openings 76. In one embodiment, the sidewall 74 may be notched or shaped to form the openings 76. In another embodiment, the barrier 70 includes a plate-shaped top portion spaced from the lower side 54, but does not include a sidewall. In this embodiment, the space between the plate and lower side 54 forms the openings 76 and liquid flows through the openings underneath the plate-shaped top portion.

The first inlet 42 is connected to a first inlet chamber 84 and the second inlet 44 is connected to a second inlet chamber 86. The first inlet chamber 84 and the second inlet chamber 86 each include one or more chamber outlet apertures 90, 90' configured to allow liquid to exit the inlet chambers 84, 86 through the chamber outlet apertures 90, 90' into the mixing module 40. The chamber outlet apertures 90, 90' are also configured to control the liquid flow rate, as discussed below. In the embodiment illustrated in FIG. 3, the first inlet chamber 84 includes one chamber outlet aperture 90 and the second inlet chamber 86 includes multiple chamber outlet apertures 90'. In another embodiment, the first inlet chamber includes one or multiple chamber outlet apertures 90 as desired and the second inlet chamber includes one or multiple chamber outlet apertures 90' as desired.

In one embodiment, the chamber outlet apertures 90 in the first inlet chamber 84 are sized to provide a first flow rate and the chamber outlet apertures 90' in the second inlet chamber 86 are sized to provide a second flow rate, where the first flow rate is different than the second flow rate. Beyond the size of the apertures, the flow rate is impacted by the number of chamber outlet apertures provided in the first inlet chamber 84 and the second inlet chamber 86. The first flow rate is a function of the sum of the flow area of each of the chamber outlet apertures 90 in the first inlet chamber 84. Similarly, the second flow rate is a function of the sum of the flow area of each of the chamber outlet apertures 90' in the second inlet chamber 86. The size and number of chamber outlet apertures 90, 90' are predetermined to provide a desired mixing ratio of the liquids flowing through the first and second inlets. The different flow rates allow for predetermined concentration of the cleaning liquids flowing out of the mixing chamber. The number of chamber outlet apertures 90 and their flow area in the first inlet chamber may be selected to provide the first flow rate between 0.5% and 100% of the second flow rate to provide a desired predetermined mixing ratio. In one embodiment, the first flow rate is between 0.5 and 10% of the second flow rate. In one embodiment, the number of chamber outlet apertures 90 and their flow areas in the first inlet chamber 84 and the number of chamber outlet apertures 90' and their flow areas in the second inlet chamber 86 are selected to provide a predetermined mixing ratio of 1:32. In one embodiment, the number of chamber outlet apertures 90 and their flow areas in the first inlet chamber 84 and the number of chamber outlet apertures 90' and their flow areas in the second inlet chamber 86 are selected to provide a predetermined mixing ratio of 1:42, in another embodiment the predetermined mixing ratio is in a range between 1:20 and 1:128.

The mixing module 40 may include a check valve 80 configured to inhibit liquid flow from the mixing chamber 50 into the first inlet 42. In the illustrated embodiment, the check valve 80 is an elastomeric umbrella check valve disposed on the downstream side of the first inlet chamber 84. The check valve 80 is sized to cover the apertures 90. The mixing module 40 may further include a second check valve 80' configured to cover the outlet apertures 90' of the second inlet chamber 86. The second check valve 80' is configured to inhibit liquid flow from the mixing module 40 into the second inlet 44. In the illustrated embodiment, the check valve 80' is an elastomeric umbrella check valve disposed on the downstream side of the second inlet chamber 86.

Figure 4:
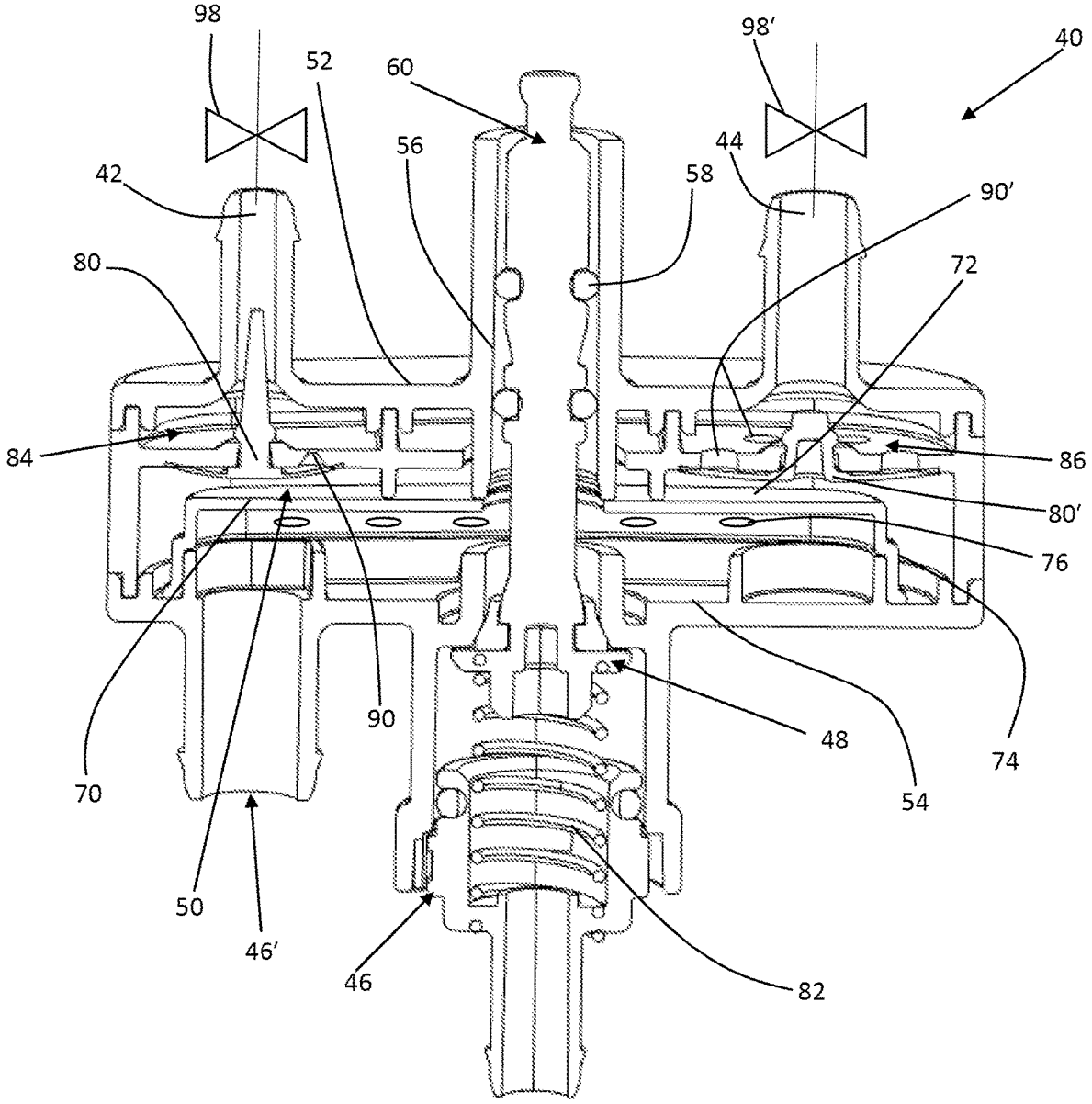
FIG. 4 is a cross-sectional view of an alternative mixing module of the floor cleaner shown in FIG. 2 including a schematic depiction of a valve arrangement.

The floor cleaner 10 may be operable in a variety of modes based on the contents of the first supply tank 22 and second supply tank 24, the status of the first inlet 42 and the second inlet 44, as well as the number and size of the apertures 90. For example, the floor cleaner may be operable in a clean mode when the first supply tank 22 contains water, the second supply tank 24 contains detergent, and the first inlet 42 and the second inlet 44 are open. As shown schematically in FIG. 4, in one embodiment the first inlet 42 and the second inlet 44 may be opened or closed by upstream valves 98 and 98', respectively. The upstream valves 98 and 98' are operable independent of each other. The floor cleaner may be operable in a rinse only mode when the first inlet 42 is open by upstream valve 98 and the second inlet 44 is closed by upstream valve 98', thus allowing only water to the surface to be cleaned. In one embodiment, upstream valves 98 and 98' are omitted and the first inlet 42 and the second inlet 44 are closed by emptying or removing the first supply tank 22 and second supply tank 24, respectively.

In one embodiment, the mixing module 40 includes only one outlet. In one embodiment, the mixing module 40 includes three of more outlets. In the illustrated embodiment, the mixing module 40 includes the first outlet 46 and the second outlet 46'. The first outlet 46 fluidly connected to the distributor in the foot portion 12 allows the floor cleaner 10 to operate in a surface cleaning mode and the second outlet 46' allows the floor cleaner 10 to operate in an above-floor cleaning mode. In one embodiment, in addition to the foot 12 configured to clean the surface to be cleaned, the floor cleaner 10 further includes an accessory tool (not shown) with a hose and a hose nozzle configured for above-floor cleaning. The accessory tool is configured to distribute cleaning liquid from the second outlet 46' and the hose nozzle is configured to draw the dirty liquid from the surface to be cleaned to the recovery tank 26. The accessory tool may be used, for example, to clean stairs, furniture, curtains, or other difficult to reach areas.

In one embodiment, the second outlet 46' is fluidly connected to the accessory tool of the floor cleaner. The second outlet 46' is in fluid communication with the accessory tool through a fluid pump to control distribution. When a fluid release trigger on the accessory tool is engaged or pressed, the fluid release trigger actuates the fluid pump drawing cleaning liquid from the mixing module 40 through the second outlet 46' for depositing on the area to be cleaned. When the fluid release trigger is not engaged or pressed, the fluid pump stops, preventing the passage of liquid solution through the second outlet 46'. In another embodiment, the second outlet 46' is connected to a fluid distributor through a valve, whereby opening the valve enables flow from the second outlet 46' and closing the valve prevents passage of liquid solution through the second outlet 46'.

In another embodiment, a method of operating a floor cleaner is disclosed. The method includes a user moving the foot 12 of the floor cleaner 10 across the surface to be cleaned and distributing a first liquid and a second liquid to the surface to be cleaned. The first liquid enters a mixing module 40 through a first inlet 42 and the second liquid enters the mixing module 40 through the second inlet 44. The method further includes actuating a user interface 62 to distribute the mixture of the first liquid and the second liquid through a first outlet. The actuation of the user interface 62 moves a closure between a closed position and an open position relative to the first outlet, to allow liquid distribution in the open position and inhibit liquid distribution in the closed position. The method may further include the user placing the body 14 of the floor cleaner 10 in an upright position and using the accessory tool in an above-surface mode to distribute a mixture of the first liquid and the second liquid through a second outlet of the mixing module to the surface to be cleaned.

Various features and advantages of the invention are set forth in the following claims.

What is claimed is:

1. A floor cleaner comprising:

a fluid flow path extending from an air inlet to an air outlet;

a fluid flow motor configured to generate air flow along the fluid flow path;

a liquid distribution assembly configured to distribute liquid to a surface to be cleaned, the liquid distribution assembly including a first supply tank for a first liquid, a second supply tank for a second liquid, and a mixing valve for mixing the first liquid and the second liquid, the mixing valve including a first inlet in communication with the first supply tank, a second inlet in communication with the second supply tank, a mixing chamber connected to the first and second inlets, an outlet, and a spring-loaded closure movable between a closed position and an open position, wherein in the closed position the spring-loaded closure closes the outlet and in the open position the spring-loaded closure opens the outlet, wherein the spring-loaded closure is operatively connected to an actuator connected to a user interface and the spring-loaded closure includes a spring pressing the closure toward the closed position, and a recovery tank positioned in the fluid flow path and configured to receive liquid-laden air from the air inlet, the recovery tank being in fluid communication with the air inlet and the air outlet.

2. The floor cleaner of claim 1, wherein the user interface is a trigger and the actuator is a rod and activating the trigger presses the rod, moving the spring-loaded closure between the closed position and the open position.

3. The floor cleaner of claim 2, wherein the rod passes through the mixing chamber.

4. The floor cleaner of claim 1, wherein the spring-loaded closure is integral with the actuator.

5. The floor cleaner of claim 4, wherein the mixing valve includes an upper side opposite a lower side, the outlet is in the lower side, the upper side includes a cylindrical bore aligned with the outlet, and the rod is movable along the bore to move the spring-loaded closure.

6. The floor cleaner of claim 1, further comprising a barrier between the outlet and at least one of the first inlet and the second inlet.

7. The floor cleaner of claim 6, wherein the barrier forms a dome covering the outlet, wherein the barrier includes an opening forming a fluid passageway between the mixing chamber and the outlet.

8. The floor cleaner of claim 6, wherein the barrier fluidly isolates the outlet from at least one of the first inlet and the second inlet, such that fluid may only flow through the opening of the barrier to reach the outlet.

9. The floor cleaner of claim 1, wherein the first inlet includes a first inlet chamber having an upstream side and a downstream side, the mixing valve further comprising an elastomeric check valve covering the downstream side of the first inlet chamber.

10. The floor cleaner of claim 9, wherein the first inlet chamber includes a first aperture sized for a first flow rate and the second inlet chamber includes a second aperture sized for a second flow rate, where the first flow rate is different than the second flow rate.

11. The floor cleaner of claim 1, wherein the outlet is fluidly connected to a distributor on a foot of the floor cleaner.

12. The floor cleaner of claim 1, wherein the outlet is a first outlet and the mixing valve further comprises a second outlet.

13. The floor cleaner of claim 12, wherein the first outlet is fluidly connected to a distributor on a foot of the floor cleaner.

14. The floor cleaner of claim 12, wherein the second outlet is fluidly connected to a fluid pump and a distributor on an accessory hose.

15. The floor cleaner of claim 12, wherein the second outlet is fluidly connected to a fluid pump or a valve.

16. A floor cleaner having a mixing chamber comprising:

a liquid distribution assembly configured to distribute liquid to a surface to be cleaned, the liquid distribution assembly including a mixing valve having a first inlet for receiving a first liquid;

a second inlet for receiving a second liquid;

an outlet for distributing the first liquid and the second liquid to the surface to be cleaned;

a barrier between the outlet and at least one of the first inlet and the second inlet;

a mixing chamber connected to the first and second inlets; and a closure operatively connected to an actuator connected to a user interface, the closure movable between a closed position in which the closure closes the outlet to prevent liquid egress and an open position in which the closure opens the outlet to allow liquid egress.

17. The floor cleaner of claim 16, wherein the user interface is a trigger and the actuator is a rod, where activating the trigger presses the rod to move the closure.

18. The floor cleaner of claim 16, wherein the closure is a spring-loaded closure.

19. The floor cleaner of claim 16, wherein the outlet includes a first outlet and a second outlet.

20. The floor cleaner of claim 19, wherein the first outlet is fluidly connected to a distributor on a foot of the floor cleaner.

21. The floor cleaner of claim 19, wherein the second outlet is fluidly connected to a fluid pump or a valve and a distributor on an accessory hose.

22. The floor cleaner of claim 19, wherein the floor cleaner is configured to operate in a first mode wherein liquid is distributed through the first outlet.

23. The floor cleaner of claim 19, wherein the floor cleaner is configured to operate in a second mode wherein the fluid pump or valve operates to distribute liquid through the second outlet.

24. A floor cleaner comprising:

a fluid flow path extending from an air inlet to an air outlet;

a fluid flow motor configured to generate air flow along the fluid flow path;

a liquid distribution assembly configured to distribute liquid to a surface to be cleaned, the liquid distribution assembly including a first supply tank for a first liquid, a second supply tank for a second liquid, and a mixing valve for mixing the first liquid and the second liquid, the mixing valve including a first inlet in communication with the first supply tank, a second inlet in communication with the second supply tank, a mixing chamber connected to the first and second inlets, an outlet, and a spring-loaded closure movable between a closed position and an open position, wherein in the closed position the spring-loaded closure closes the outlet and in the open position the spring-loaded closure opens the outlet, the outlet is fluidly connected to a distributor on a foot of the floor cleaner wherein the spring-loaded closure is operatively connected to an actuator connected to a user interface, and a recovery tank positioned in the fluid flow path and configured to receive liquid-laden air from the air inlet, the recovery tank being in fluid communication with the air inlet and the air outlet.

25. The floor cleaner of claim 24, wherein the user interface is a trigger and the actuator is a rod and activating the trigger presses the rod, moving the spring-loaded closure between the closed position and the open position.

* * * * *